US010018173B2

(12) United States Patent
Skowronek et al.

(10) Patent No.: US 10,018,173 B2
(45) Date of Patent: Jul. 10, 2018

(54) METHOD FOR OPERATING AN IGNITION SYSTEM AND A CORRESPONDING IGNITION SYSTEM

(71) Applicant: Robert Bosch GmbH, Stuttgart (DE)

(72) Inventors: Tim Skowronek, Missen-Wilhams (DE); Thomas Pawlak, Immenstadt (DE); Wolfgang Sinz, Hergatz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 53 days.

(21) Appl. No.: 15/034,701

(22) PCT Filed: Oct. 21, 2014

(86) PCT No.: PCT/EP2014/072533

§ 371 (c)(1),
(2) Date: Jul. 26, 2016

(87) PCT Pub. No.: WO2015/071055

PCT Pub. Date: May 21, 2015

(65) Prior Publication Data

US 2017/0138329 A1 May 18, 2017

(30) Foreign Application Priority Data

Nov. 14, 2013 (DE) ..... 10 2013 223 182
Aug. 13, 2014 (DE) ..... 10 2014 216 024

(51) Int. Cl.
*F02P 11/02* (2006.01)
*F02P 15/08* (2006.01)
*F02P 17/12* (2006.01)

(52) U.S. Cl.
CPC ..... *F02P 11/02* (2013.01); *F02P 15/08* (2013.01); *F02P 17/12* (2013.01); *F02P 2017/121* (2013.01)

(58) Field of Classification Search
CPC .. F02P 11/02; F02P 15/08; F02P 17/12; F02P 2017/121
See application file for complete search history.

(56) References Cited

U.S. PATENT DOCUMENTS 3,490,426 A * 1/1970 Farr ..... F02P 1/086 123/149 D
3,510,236 A * 5/1970 Potts ..... F23N 5/123 431/29

(Continued)

FOREIGN PATENT DOCUMENTS

CN 103153738 A 6/2013
DE 10250736 A1 5/2004

(Continued)

OTHER PUBLICATIONS

International Search Report dated Jan. 22, 2015 for International Application No. PCT/EP2014/072533.

*Primary Examiner* — Joseph Dallo
(74) *Attorney, Agent, or Firm* — Norton Rose Fulbright US LLP; Gerard Messina

(57) ABSTRACT

An ignition system and a method for suppressing an ignition spark discharge at a spark gap at an unsuitable time are provided. The method includes a recognition of a spark breakaway and/or a failed ignition and, in response thereto, by producing a conductive path via an ignition spark at the spark gap at a suitable time.

10 Claims, 2 Drawing Sheets

(56) References Cited

U.S. PATENT DOCUMENTS 3,545,420 A * 12/1970 Hufton ..... F02P 1/086 123/149 D
3,606,873 A * 9/1971 Rademacher et al. ..... F02N 99/002 123/179.6
3,766,441 A * 10/1973 Gray ..... F23N 5/123 340/579
4,033,316 A * 7/1977 Birchenough ..... F02P 9/007 123/598
4,136,301 A * 1/1979 Shimojo ..... F02P 9/007 123/596
4,191,912 A * 3/1980 Gerry ..... F02P 7/035 123/606
4,216,755 A * 8/1980 Ordines ..... F02P 7/03 123/643
4,393,817 A * 7/1983 Lindberg ..... F02B 43/08 123/25 E
4,409,931 A * 10/1983 Lindberg ..... F02B 43/08 123/25 E
4,462,380 A 7/1984 Asik
4,541,367 A * 9/1985 Lindberg ..... F02B 43/08 123/25 F
4,558,685 A * 12/1985 Ishikawa ..... F02P 3/0884 123/620
4,596,227 A * 6/1986 Hashizume ..... F02P 7/035 123/480
4,631,451 A * 12/1986 Anderson ..... F02P 9/007 123/620
4,915,087 A * 4/1990 Boyer ..... F02P 7/035 123/620
5,188,088 A * 2/1993 Stamm ..... F02P 3/005 123/620
5,193,515 A * 3/1993 Oota ..... F02P 3/0892 123/604
5,211,152 A * 5/1993 Alexandrov ..... F02P 3/0554 123/620
5,404,860 A * 4/1995 Morino ..... F02P 3/005 123/605
5,806,505 A * 9/1998 Herbert ..... F02P 13/00 123/621
6,138,653 A * 10/2000 Juffinger ..... F02P 15/10 123/598
7,677,230 B2 * 3/2010 Meyer ..... F02P 15/04 123/605
7,681,562 B2 * 3/2010 Boerjes ..... F02P 3/053 123/595
7,992,542 B2 * 8/2011 Glugla ..... F02P 3/04 123/406.2
8,286,617 B2 * 10/2012 Grady ..... F02P 3/04 123/605
9,531,165 B2 * 12/2016 Ruan ..... F02P 3/053
2006/0005804 A1 * 1/2006 Kuo ..... F02D 13/0207 123/295
2016/0312757 A1 * 10/2016 Skowronek ..... F02P 9/007

FOREIGN PATENT DOCUMENTS

DE 102009046397 A 5/2010
DE 102010010465 A1 12/2010
JP 60156977 A 8/1985
JP 60178967 A 9/1985

* cited by examiner

METHOD FOR OPERATING AN IGNITION SYSTEM AND A CORRESPONDING IGNITION SYSTEM

FIELD OF THE INVENTION

The present invention relates to an ignition system for an internal combustion engine and to a method for operating an ignition system. In particular, an ignition spark discharge at a spark gap at an unsuitable time is to be suppressed.

BACKGROUND INFORMATION

In the related art, ignition systems for spark-ignited internal combustion engines are believed to be understood in which, for example, a flow of current through the primary side of an inductive system is interrupted, causing at the secondary side a spark over a spark gap, provided specifically for this purpose, in the combustion chamber of the internal combustion engine. If the spark crosses through an ignitable mixture at the time of ignition, the mixture combusts and drives the engine. However, due to various circumstances, the ignition spark may be extinguished prematurely, or may not be produced at all. In this case residual energy can remain in the capacitances of the ignition system, which can also be for example parasitic capacitances of the secondary winding or parasitic capacitances of other discrete components such as closing spark suppression diodes. Thus, a voltage continues to be present over the spark gap. This can have the result that at a later, inappropriate time an undesirable discharge, and thus ignition spark formation, can take place in the combustion chamber, because for example at this time a lower mixture pressure and/or a lower turbulence of the mixture prevail in the combustion chamber. If the spark produced by a residual charge causes a combustion, serious damage to the engine can result.

SUMMARY OF THE INVENTION

Therefore, an object of the present invention is to suppress or to prevent an ignition spark discharge at a spark gap at an unsuitable time.

The object named above may be achieved according to the present invention by a method for suppressing an ignition spark discharge at a spark gap at an unsuitable time, and by an ignition system according to the present invention that supplements the existing art by a voltage measurement and an arrangement for carrying out the method according to the present invention, for an internal combustion engine. The method includes a production of a conductive path via an ignition spark at the spark gap at a time before the theoretically unsuitable time. At least in the case in which an ignition spark discharge at an unsuitable time is to be suppressed, through the timely production of an ignition spark the remaining charge is therefore dismantled by producing a conductive path in the combustion chamber at the spark gap. Here the time is selected such that no damage to the internal combustion engine can occur.

Exemplary developments of the present invention are further described herein.

The time for the production of the conductive path may be selected such that a comparatively low turbulence prevails in a mixture flowing around the spark gap. In this way, failure also of the controlled discharge ignition for suppressing the ignition spark discharge, due to fluid movements in the combustion chamber, is prevented.

Further, the time of the production of the conductive path may be situated in a working stroke in which there takes place a combustion and/or an ejection of fluid from a combustion chamber containing the spark gap. Because the combustion and ejection strokes take place before the intake and compression strokes (i.e. the strokes that are more critical with regard to an uncontrolled ignition of the mixture), in this way an uncontrolled ignition that could damage the engine can be avoided. Alternatively or in addition, the time for the production of the conductive path can be selected such that the discharge ignition is situated at a suitable time in the working strokes "intake" and "compression," if the residual energy stored in one or more electrical energy storage devices of the ignition system is below a specified threshold value. Thus, the discharge ignition is permitted to have only a quantity of residual energy that is not sufficient to ignite the fuel mixture in the combustion chamber. In this way, via an additional ignition a later uncontrolled ignition can be prevented, and the internal combustion engine can be protected in this way.

Further, the ignition spark discharge to be suppressed may be caused by a spark breakaway. In other words, an ignition first results in the risk of an ignition spark discharge that is to be suppressed. Subsequently, according to the present invention the conductive path for discharging the ignition system is produced at the suitable time. In this way, reliable avoidance of ignition spark discharges at unsuitable times is ensured.

Further, the method according to the present invention may include recognition of a spark breakaway and/or recognition of a failed ignition. In response to this, a conductive path is produced by the ignition spark at the ignition spark gap. To realize these method steps, the ignition spark voltages or currents can be evaluated. The measurement of ignition spark currents can for example take place at the secondary side of the ignition system using an electronic evaluation unit that is in particular assigned to a respective ignition spark gap (spark plug). In this way, when there is no spark breakaway a standard discharge ignition at a suitable time is made unnecessary, saving energy and reducing the load on the components of the ignition system.

As an alternative to the named embodiment, a standard production of the conductive path via the ignition spark at the spark gap following each ignition time is also possible. This can relate to individual operating states (e.g. communicated by a control device), and also to all the operating states, of the ignition system. In this way, an evaluation of current electrical or electrodynamic or thermodynamic quantities is made unnecessary, which can reduce the hardware outlay. In addition, this method is more robust against measurement errors.

It is very advantageous if, temporally before the production of the conductive path, it is ascertained whether residual energy is present in an electrical capacitance of the ignition system, because in this way it can be recognized whether there is a threat of an undesired ignition spark discharge.

In addition, temporally before producing the conductive gap it is checked whether no ignitable mixture is present in a combustion chamber of an internal combustion engine. In this way, it is ensured that the defined discharging of the residual energy remaining in the capacitor after a spark breakaway does not cause an ignition in the combustion chamber of the internal combustion engine. Thus, for the discharging of the residual energy an electrically conductive spark gap is produced only in a non-ignitable environment.

It is advantageous if, according to a first alternative, the production of a spark gap is triggered internally in the ignition system, for example in an internal control device or in internal electronics modules, because in this way the ignition system recognizes automatically if a defined discharging is necessary, and the outlay for communication with an external control device can be reduced. It is also advantageous if, according to a second alternative, the production of a spark gap is also triggered by an external control device, for example an engine control device, because in this way the outlay inside the ignition system can be reduced, and the defined discharging can be controlled as a function of the operating states of the combustion chamber conditions, acquired in the control device.

The ignition system for an internal combustion engine with which the method according to the present invention is carried out includes a first electrode and a second electrode of a spark gap at which an ignition spark is produced, and that is used to ignite combustible mixture in a combustion chamber of the internal combustion engine. In addition, the ignition system has a voltage generator for producing an ignition spark. The voltage generator can for example be fashioned inductively, such that when a primary-side current is switched off, a secondary-side ignition voltage is produced. In principle, the first voltage generator can also be supported by further voltage generators during the ignition or maintenance of an existing ignition spark. In addition, the ignition system includes a control unit or regulating unit for controlling the voltage generator. Via the control unit, for example an ignition time or a production of an ignition spark at a suitable time (see above) is controlled and initiated. The controlling for producing a quenched spark can be realized internally by the ignition system or externally by the control device (parameterization of the ignition characteristic field), and here as well a controlling as a function of further operating parameters is possible (e.g. quenched spark only in case of A) full load or B) high load-EGR). According to the present invention, the ignition system is set up to carry out a method as described in detail above. In other words, the ignition system is capable of realizing all embodiments described in connection with the first-named aspect of the present invention. In addition, therefore, reference is made to the above features and feature combinations and to the advantages associated therewith.

The ignition system may include a voltage sensor that is set up to detect an electrical voltage remaining in the ignition system after a regular ignition time for mixture combustion, and, in response to an exceeding of a predefined threshold value of the voltage, to initiate the production of the conductive path via the ignition spark at the spark gap. In other words, a sensor system is used to recognize and to initiate a request for a discharging according to the present invention of the ignition system. In this way, a standard discharging of the ignition system, for example after a predefined time window that follows each regular ignition time, is rendered unnecessary.

In the context of the present invention, an ignition is regarded as successful if a spark arc-over occurs and the electrically stored energy is dismantled to a value below a predefined threshold value.

In the case of an unsuccessful ignition, two cases are to be distinguished. In the first case, the spark does not cause mixture combustion; this is referred to as failed ignition. The remaining residual energy in the ignition system can cause malfunctions in further operation. In a second case, the spark does cause mixture combustion, but in a manner that does not correspond to a classic failed ignition and is designated spark breakaway, because the spark breaks away prematurely, so that electrical residual energy remains in the ignition system. An ignition that is not successful in the sense of the present invention is accordingly present when the remaining electrical residual energy in the ignition system exceeds a predefined threshold value.

An ignition system with which the method according to the present invention is carried out includes a (discrete or parasitic) capacitance that, in the case of an unsuccessful ignition with excessive residual energy content due to spark breakaway, stores a voltage that in turn is at least partially discharged by an ignition spark at the spark gap at a suitable time. The capacitance can for example be contained in a secondary-side loop of the ignition system together with the spark gap in order to store energy that is used to maintain the ignition spark after the ignition. Because in the case of an unsuccessful ignition this capacitance retains energy that could cause a problematic uncontrolled and undesired ignition in the combustion chamber at an unsuitable ignition time, the present invention can provide a remedy here.

Further, the production of the conductive path may take place via the ignition spark, in other words the discharge ignition at the spark gap via the same voltage generator that prepared the ignition spark discharge that is to be suppressed. In other words, only an additional controlling of the voltage generator is required in order to implement the present invention in a known ignition system. An additional hardware outlay is therefore made unnecessary.

In the following, exemplary embodiments of the present invention are described in detail with reference to the accompanying drawings.

DETAILED DESCRIPTION

Figure 1:
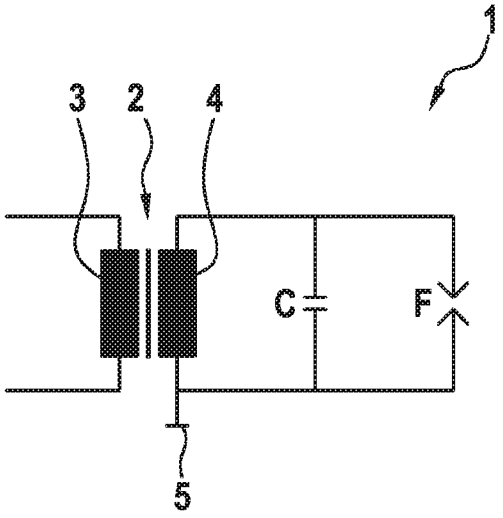
FIG. 1 shows a schematic diagram of a part of an exemplary embodiment of an ignition system according to the present invention.

FIG. 1 shows an ignition system 1 that has a transformer 2 having a primary side 3 and a secondary side 4 as voltage generator. Primary side 3 and secondary side 4 are magnetically coupled. Parallel to secondary side 4 are situated both a capacitance C and a spark gap F. Secondary side 4 is grounded to electrical ground 5 by an electrical contact.

Figure 2:
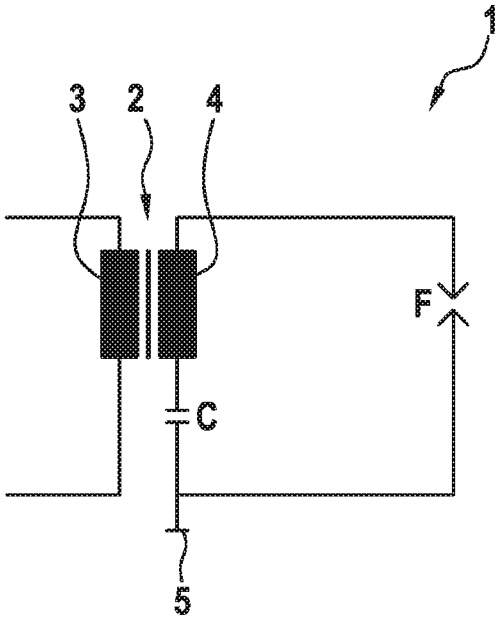
FIG. 2 shows a schematic diagram of a part of an alternative exemplary embodiment of an ignition system according to the present invention.

FIG. 2 shows an alternative exemplary embodiment of an ignition system 1 according to the present invention. In contrast to the configuration shown in FIG. 1, capacitance C is configured in series to secondary side 4 of transformer 2. Secondary side 4, capacitance C, and spark gap F are thus situated in a single common loop.

Figure 3:
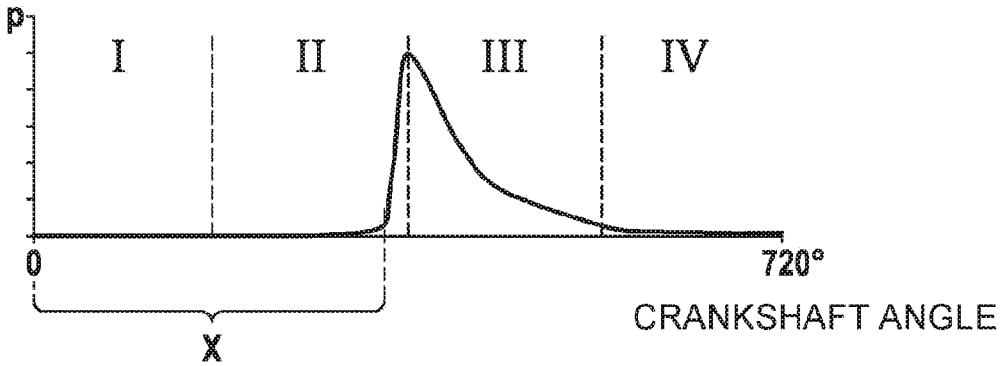
FIG. 3 shows a pressure-crankshaft angle diagram illustrating pressure relationships during various working strokes of an internal combustion engine.

FIG. 3 shows a schematic pressure curve in the combustion chamber of an internal combustion engine over the crank angle (measured in "degrees crank angle"). The four working strokes of an Otto engine are shown: intake I, compression II, combustion III, ejection IV. The strokes intake I and compression II represent a critical region X for the discharging of an uncontrolled spark. During a controlled ignition in the region of a transition from the second stroke compression II to the third stroke combustion III, a discharge of the ignition system according to the present invention should take place in the regions combustion III and ejection IV (as the recited suitable time). In this way, a discharge takes place before, via the remaining charge, in a following work cycle the critical region designated X enables a damaging, uncontrolled combustion. In regions I and II, a quenched spark can also be provoked; here care is to be taken that the discharge does not release enough energy to cause mixture combustion.

Figure 4:
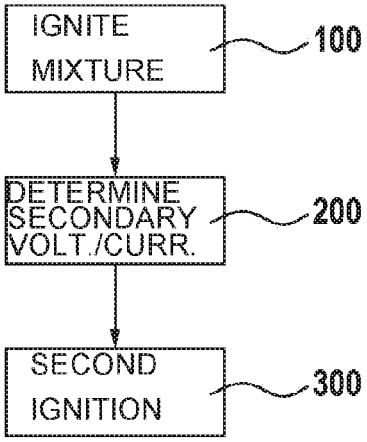
FIG. 4 shows a flow diagram illustrating steps of an exemplary embodiment of a method according to the present invention.

FIG. 4 shows a flow diagram illustrating steps of an exemplary embodiment of a method according to the present invention.

In step 100, an attempt is undertaken to ignite a mixture in the combustion chamber. The ignition attempt can fail, corresponding to a failed ignition, a critical spark current breakaway, or an excessive amount of remaining capacitively stored residual energy. This is recognized in step 200 by ascertaining and evaluating a secondary-side voltage and/or a secondary-side current. In the case of the evaluation of the secondary-side current, it is checked whether this current exceeds a specified threshold value. If this threshold value is exceeded, it is checked whether a suitable time is present for dismantling the residual energy, by ascertaining whether no ignitable mixture is present in a combustion chamber of an internal combustion engine. If no ignitable mixture is present in the combustion chamber, then in step 300 there takes place a second ignition, i.e. at a suitable time, which may take place in strokes III, IV (see FIG. 3).

A core idea of the present invention is that after the combustion process, in an uncritical state, a discharge spark is produced at the spark plug electrodes in the combustion chamber, as can take place for example via a corresponding supply of current to, and switching off of, the primary coil of the ignition coil. Through the resulting discharge spark, there arises a conductive path via which the remaining energy of the capacitances of the secondary side of the ignition system can discharge. This process may be carried out with low turbulence in the combustion chamber. Due to the low turbulence, the spark breaks away at an uncritically low voltage value or current value. Thus, the stored energy is converted almost completely into spark. The residual energy corresponding to the low value of the spark current is below the energy required for an uncontrolled ignition. The method according to the present invention can be triggered optionally at each ignition, after a detected spark breakaway, or when there is a detected failed ignition (e.g. by omitting a main ignition in the region of top dead center, or of a spark breakaway).

According to a first alternative, the production of an ignition spark in step 300 can take place internally in the ignition system, for example in an internal control device or in internal electronics modules. According to a second alternative, the production of an ignition spark can also be triggered by an external control device, for example an engine control device.

In the exemplary embodiments according to FIG. 1 and FIG. 2, steps 200, 300 can include the following steps: the secondary-side current is ascertained and a spark breakaway and/or a failed ignition is recognized via an abrupt change in the secondary-side current. This takes place by checking whether the magnitude of the change of the secondary-side current exceeds a specified first threshold value. If this is the case, an exceeding condition is met.

Instead of the secondary-side current, a secondary-side voltage can also be acquired that may be ascertained only after a specified temporal delay after a starting time of the method, in order to have a stationary state in the ignition system. The temporal delay is for example a function of rotational speed and/or is a function of a crankshaft angle. A spark breakaway and/or a failed ignition is recognized when the acquired secondary-side voltage exceeds a specified second threshold value. If this is the case, the exceeding condition is met.

It is thereupon ascertained whether an ignition condition is met by checking whether no ignitable mixture is present in a combustion chamber of an internal combustion engine. If the exceeding condition and the ignition condition are met, in step 300 a conductive path is produced by an ignition spark.

In a further exemplary embodiment, the ignition system additionally includes a step-up converter for maintaining an ignition spark. Such an ignition system having a step-up converter is disclosed for example in DE 10 2013 218227 A1, whose content is expressly incorporated in the disclosure of the present application.

The step-up converter according to the present invention includes, as in DE 10 2013 218227 A1, an inductance, a switch, a capacitance C, and a diode. The inductance of the step-up converter is fashioned in the form of a transformer having a primary side and a secondary side. Here the inductance acts as an energy storage device for charging the capacitor. Capacitance C of the step-up converter is configured, as in FIG. 2, in series with secondary side 4 of transformer 2. The output power of the step-up converter is, with regard to FIG. 2, fed into secondary side 4 of ignition system 1 via a node point situated between secondary side 4 of transformer 2 and capacitance C, and is supplied to spark gap F. The output voltage of the step-up converter is correspondingly present at the stated node point.

According to the present invention, in the further exemplary embodiment as well it is recognized that residual energy is present in an electrical capacitance C of the ignition system. Upon this recognition, at a suitable time an ignition spark is produced. Electrical capacitance C can be a capacitor of the step-up converter or a parasitic capacitance in the ignition system.

In the exemplary embodiment having the step-up converter, step 200 includes the following steps: first, it is ascertained whether the step-up converter of the ignition system is switched off. If this is the case, an output voltage of the step-up converter is measured, in particular after expiration of a specified time period after the switching off of the step-up converter, in order to have a stationary state in the ignition system. Subsequently it is ascertained whether the measured output voltage exceeds a specified second threshold value. If the second threshold value is exceeded, an unsuccessful ignition can be inferred, because too much residual energy is stored in the capacitance of the step-up converter, so that there is the risk of an unintended ignition at an unsuitable time. Thereupon it is checked whether a suitable time for dismantling the residual energy is present, by ascertaining whether no ignitable mixture is present in a combustion chamber of an internal combustion engine. If no ignitable mixture is present in the combustion chamber, a suitable time is present and an ignition is initiated according to step 300.

Alternatively, in the further exemplary embodiment the unsuccessful ignition can be determined by measuring an ignition spark current. In this case, step 200 includes the following steps: first, the ignition spark current is measured. Thereupon it is ascertained whether the measured ignition spark current falls below a specified third threshold value. If the current is below the third threshold value, an unsuccessful ignition can be inferred. Through the further operation of the step-up converter after the unsuccessful ignition, the voltage over the output capacitance of the step-up converter increases further, increasing the risk of an undesired spark discharge. Therefore, it is ascertained whether the unsuccessful ignition has taken place with switched-on or switched-off step-up converter. If the step-up converter is switched on, it is additionally ascertained whether a time difference between the time of the first falling below the second threshold value and a known end of the operation of the step-up converter exceeds a specified fourth threshold value. If the fourth threshold value has been exceeded, too much residual energy is stored in the capacitance of the step-up converter, so that there is the risk of an unintended ignition. Thereupon it is checked whether a suitable time is present for dismantling the residual energy, by ascertaining whether no ignitable mixture is present in a combustion chamber of the internal combustion engine. If no ignitable mixture is present in the combustion changer and the above conditions are met, the ignition is initiated according to step 300.

A computer program can be provided that is set up to carry out all described steps of the method according to the present invention. The computer program is stored on a storage medium. Alternatively to the computer program, the method according to the present invention can be controlled by an electronic circuit provided in the ignition system, an analog circuit, or an ASIC or a microcontroller that is set up to carry out all described steps of the method according to the present invention.

Although the aspects and advantageous specific embodiments according to the present invention have been described in detail on the basis of exemplary embodiments explained in connection with the accompanying drawings, a person skilled in the art will be capable of realizing modifications and combinations of features of the presented exemplary embodiments without departing from the scope of the present invention, whose scope of protection is defined by the entirety of the present application.

What is claimed is:

1. A method for operating an ignition system for an internal combustion engine, the ignition system including a voltage generator and a spark gap for producing an ignition spark, the method comprising:

recognizing at least one of a spark breakaway and a failed ignition by performing the following:

ascertaining a secondary-side current or a secondary-side voltage, ascertaining whether an exceeding condition is met by ascertaining whether a change in the secondary-side current or the secondary-side voltage exceeds a specified first threshold value, ascertaining whether an ignition condition is met by ascertaining whether no ignitable mixture is present in a combustion chamber of an internal combustion engine, the ignition condition being met if no ignitable mixture is present in the combustion engine of the internal combustion engine; and producing, in response thereto, a conductive path via an ignition spark at the spark gap in a working stroke (I, II, III, IV) of the internal combustion engine if the exceeding condition and the ignition condition are met, in which a combustion (III) and/or an ejection (IV) of fluid from a combustion chamber containing the spark gap takes place, and/or in which an intake (I) and/or compression (II) takes place, and in which residual energy stored in at least one electrical energy storage device of the ignition system is below a specified threshold value.

2. The method of claim 1, wherein the ignition system includes a step-up converter for maintaining an ignition spark that includes an electrical capacitance for the intermediate storage of ignition energy, and wherein the recognizing and producing tasks include the following:

ascertaining whether a state condition is met by ascertaining whether the step-up converter of the ignition system is switched off, measuring an output voltage of the step-up converter, ascertaining whether an exceeding condition is met by ascertaining whether the measured output voltage exceeds a specified second threshold value, ascertaining whether an ignition condition is met by ascertaining whether no ignitable mixture is present in a combustion chamber of an internal combustion engine, and producing a conductive path via an ignition spark if the state condition, the exceeding condition, and the ignition condition are met.

3. The method of claim 1, wherein the ignition system includes a step-up converter for maintaining an ignition spark that includes an electrical capacitance for the intermediate storage of ignition energy, and wherein the recognizing and producing tasks include the following:

ascertaining whether a state condition is met by ascertaining whether the step-up converter of the ignition system is switched on, measuring an ignition spark current, ascertaining whether a falling-below condition is met by ascertaining whether the measured ignition spark current falls below a specified third threshold value, ascertaining whether an exceeding condition is met by ascertaining whether a time difference between the time of the first falling below the third threshold value and an end of the operation of the step-up converter exceeds a specified fourth threshold value, ascertaining whether an ignition condition is met by ascertaining whether no ignitable mixture is present in a combustion chamber of an internal combustion engine, and producing a conductive path via an ignition spark when the falling-below condition, the state condition, the exceeding condition, and the ignition condition are met.

4. The method of claim 1, wherein the production of the conductive path occurs via the ignition spark at the spark gap following each ignition time of an operating state under consideration, or of all operating states, in particular with initiation of a signaling of a control device of the ignition system.

5. A machine-readable storage medium having a computer program, which is executable by a processor, comprising:

a program code arrangement having program code for operating an ignition system for an internal combustion engine, the ignition system including a voltage generator and a spark gap for producing an ignition spark, by performing the following:

recognizing, via the processor, at least one of a spark breakaway and a failed ignition by performing the following:

ascertaining a secondary-side current or a secondary-side voltage, ascertaining whether an exceeding condition is met by ascertaining whether a change in the secondary-side current or the secondary-side voltage exceeds a specified first threshold value, ascertaining whether an ignition condition is met by ascertaining whether no ignitable mixture is present in a combustion chamber of an internal combustion engine, the ignition condition being met if no ignitable mixture is present in the combustion engine of the internal combustion engine; and producing, via the processor, in response thereto, a conductive path via an ignition spark at the spark gap in a working stroke (I, II, III, IV) of the internal combustion engine if the exceeding condition and the ignition condition are met, in which a combustion (III) and/or an ejection (IV) of fluid from a combustion chamber containing the spark gap takes place, and/or in which an intake (I) and/or compression (II) takes place, and in which residual energy stored in at least one electrical energy storage device of the ignition system is below a specified threshold value.

6. An ignition system for an internal combustion engine, comprising:

an ignition device, including:

a first electrode and a second electrode of a spark gap;

a first voltage generator for producing an ignition spark;

a control unit for controlling the voltage generator so as to operating the ignition device, the ignition system including the first voltage generator and the spark gap for producing the ignition spark, by performing the following:

recognizing, via the processor, at least one of a spark breakaway and a failed ignition by performing the following:

ascertaining a secondary-side current or a secondary-side voltage, ascertaining whether an exceeding condition is met by ascertaining whether a change in the secondary-side current or the secondary-side voltage exceeds a specified first threshold value, ascertaining whether an ignition condition is met by ascertaining whether no ignitable mixture is present in a combustion chamber of an internal combustion engine, the ignition condition being met if no ignitable mixture is present in the combustion engine of the internal combustion engine; and producing, via the processor, in response thereto, a conductive path via an ignition spark at the spark gap in a working stroke (I, II, III, IV) of the internal combustion engine if the exceeding condition and the ignition condition are met, in which a combustion (III) and/or an ejection (IV) of fluid from a combustion chamber containing the spark gap takes place, and/or in which an intake (I) and/or compression (II) takes place, and in which residual energy stored in at least one electrical energy storage device of the ignition system is below a specified threshold value.

7. The ignition system of claim 6, further comprising:

a voltage sensor to detect, after an ignition time, an electrical voltage remaining in the ignition system, and to initiate, in response to an exceeding of a defined threshold value of the voltage and of a dead time, the production of the conductive path via the ignition spark at the spark gap.

8. The ignition system of claim 6, further comprising:

a capacitance device that, in the case of an unsuccessful ignition, stores a voltage that is at least partly discharged via an ignition spark at the spark gap at a particular time.

9. The ignition system of claim 6, wherein the production of the conductive path via the ignition spark at the spark gap occurs via the same voltage generator that prepared the ignition spark discharge to be suppressed.

10. The method of claim 1, wherein the production of the conductive path via the ignition spark at the spark gap occurs via the same voltage generator that prepared the ignition spark discharge to be suppressed.

* * * * *